US006118883A

United States Patent [19]

Rocha

[11] Patent Number: 6,118,883

[45] Date of Patent: Sep. 12, 2000

[54] SYSTEM FOR CONTROLLING LOW FREQUENCY ACOUSTICAL DIRECTIVITY PATTERNS AND MINIMIZING DIRECTIVITY DISCONTINUITIES DURING FREQUENCY TRANSITIONS

[75] Inventor: Jeffrey A. Rocha, Douglas, Mass.

[73] Assignee: Eastern Acoustic Works, Inc., Whitinsville, Mass.

[21] Appl. No.: 09/160,124

[22] Filed: Sep. 24, 1998

[51] Int. Cl.[7] ..... H04R 25/00

[52] U.S. Cl. ..... 381/387; 381/387; 381/345; 381/340; 381/342; 381/186; 181/144; 181/147; 181/152; 181/199

[58] Field of Search ..... 381/387, 345, 381/351, 386, 340, 342, 182, 186; 181/198, 199, 152, 159, 144, 145, 147

[56] References Cited

U.S. PATENT DOCUMENTS

| | | | |
|---|---|---|---|
| Re. 32,183 | 6/1986 | Isaacs | 181/185 |
| 4,050,541 | 9/1977 | Henricksen | 181/159 |
| 4,176,731 | 12/1979 | Sinclair | 181/192 |
| 4,180,710 | 12/1979 | Spranger | 179/115.5 H |
| 4,187,926 | 2/1980 | Henricksen et al. | 181/192 |
| 4,325,456 | 4/1982 | Ureda | 181/159 |
| 4,391,346 | 7/1983 | Murakami et al. | 181/147 |
| 4,437,540 | 3/1984 | Murakami et al. | 181/147 |
| 4,836,327 | 6/1989 | Andrews et al. | 181/152 |
| 4,882,562 | 11/1989 | Andrews et al. | 340/388 |
| 4,885,782 | 12/1989 | Eberbach | 381/186 |
| 5,386,479 | 1/1995 | Hersh | 381/190 |
| 5,526,456 | 6/1996 | Heinz | 381/156 |
| 5,642,429 | 6/1997 | Janssen | 381/182 |

*Primary Examiner*—Curtis A. Kuntz
*Assistant Examiner*—Suhan Ni
*Attorney, Agent, or Firm*—McDermott, Will & Emery

[57] ABSTRACT

An improved loudspeaker system which increases low frequency directivity and minimizes directivity discontinuities during frequency transitions includes a first low frequency transducer, a second low frequency transducer, a middle frequency transducer assembly and a middle frequency horn assembly having a small input aperture and a large output aperture. The middle frequency transducer assembly is attached at the small aperture of the horn assembly and directs a middle frequency acoustical signal into the horn assembly. The low frequency transducers and are mounted to opposite interior surfaces, preferably the top and bottom surfaces, of the horn assembly, and direct a low frequency acoustical signal into the horn assembly. A composite acoustical signal directed out of the horn assembly from the large aperture. The distance $D_1$, measured from the upper transducer voice coil to the lower transducer voice coil, is substantially equal to 0.9048 of the distance $D_2$, measured from the bottom edge of the output aperture to the top edge of the output aperture. Such a relationship between D1 and D2 results in a smooth transition and a substantially continuous acoustical beamwidth in the composite acoustic signal within low frequency to middle frequency crossover band.

8 Claims, 6 Drawing Sheets

SYSTEM FOR CONTROLLING LOW FREQUENCY ACOUSTICAL DIRECTIVITY PATTERNS AND MINIMIZING DIRECTIVITY DISCONTINUITIES DURING FREQUENCY TRANSITIONS

FIELD OF THE INVENTION

The present invention relates to loudspeaker systems, and more particularly to loudspeaker systems which increase low frequency directivity and minimize directivity discontinuities during frequency transitions.

BACKGROUND OF THE INVENTION

A loudspeaker is a device which converts an electrical signal into an acoustical signal (i.e., sound) and directs the acoustical signal to one or more listeners. In general, a loudspeaker includes an electromagnetic transducer which receives and transforms the electrical signal into a mechanical vibration. The mechanical vibrations produce localized variations in pressure about the ambient atmospheric pressure; the pressure variations propagate within the atmospheric medium to form the acoustical signal. When the wavelength of a radiated acoustical signal is much larger than the physical dimensions of the device producing the signal, the radiation pattern tends toward omnidirectional. However, many applications require a device with a significant level of directivity. Typically, the target listening audience is localized in a particular region relative to the source, and an omnidirectional radiator directs the acoustical signal to regions other than the target region.

Even at low frequencies, a somewhat directional pattern may be obtained by utilizing two sources. If two sources are placed on a vertical axis separated by a distance D, the resulting acoustical signal will be completely nulled above and below the sources when D is $\lambda/2$, $\lambda$ being the wavelength of the acoustical signal radiated by the sources. The frequency corresponding to such a wavelength is referred to as the Maximum Off-Axis Rejection Frequency. Even when the wavelength of the signal varies from $\lambda/2$ by moderate amounts, a significant null remains above and below the radiators. When measured with typical ⅓ octave band resolution, such a configuration produces a minimum vertical beamwidth of 160 degrees over a ⅓ octave. The beamwidth of an acoustical system is defined as the angle that includes all of the acoustical output that is within 6 dB of the maximum output. The vertical beamwidth is the beamwidth within a vertical plane relative to the radiator.

An ideal loudspeaker would provide consistent radiation pattern control over the entire working frequency range. In a typical application, many loudspeakers will be incorporated into an array to provide sound to a wide listening area. If the radiation patterns of the loudspeakers within the array do not remain consistent with respect to frequency, particular listeners may be left out at some frequencies (as the beamwidths narrow) and particular listeners may be in an overlap region for some frequencies (as the beamwidths widen). An overlap may cause interference patterns to occur which distort the true acoustical signal. Thus, an inconsistent radiation pattern with respect to frequency makes it difficult to predictably array loudspeakers.

Considering the aforementioned limitations at low frequencies, a practical vertical beamwidth-verses-frequency goal is shown in FIG. 1. At the lowest working frequency, the vertical beamwidth is approximately 160 degrees. As the frequency increases, the beamwidth gradually narrows to the target middle/high frequency directivity (in this case approximately 35 degrees), at which point the curve flattens out, and the beamwidth remains relatively constant for increasing frequencies. One problem with realizing the directional characteristics of FIG. 1 is that a single driver normally cannot produce the entire desired frequency range, and therefore several drivers are often used to construct a loudspeaker system(i.e., two-way loudspeaker systems, three-way loudspeaker systems, etc.), where each driver is specifically designed to produce a particular frequency range. Crossover networks within the loudspeaker system receive the composite input signal, separate it into multiple frequency bands and provide a signal, representative of each frequency band, to each appropriate driver. The filters within the crossover network are not ideal, and so the frequency bands that the drivers receive overlap to some extent. Thus, the crossover frequency is a frequency within a crossover band. Since each driver is typically a unique design for a particular frequency band, each driver tends to have a unique beamwidth-verses-frequency characteristic, independent of the other drivers within the system. Consequently, a beamwidth discontinuity may occur at a crossover frequency, as shown in FIG. 2. Such a discontinuity causes the directional characteristics of the overall loudspeaker system to deviate from the ideal beamwidth-verses-frequency characteristic shown in FIG. 1.

It is an object of this invention to provide a loudspeaker system that substantially overcomes the aforementioned disadvantages.

It is another object of this invention to provide a loudspeaker system that exhibits a continuous and consistent beamwidth-verses-frequency characteristic over the entire working frequency range.

It is a further object of this invention to provide a loudspeaker system that exhibits continuous consistent directional pattern characteristics verses frequency, while occupying a relatively small amount of physical space.

SUMMARY OF THE INVENTION

The present invention is a loudspeaker system for receiving an electrical signal and transmitting an acoustical signal, where the acoustical signal is directional and has a substantially continuous beamwidth across a plurality of frequency transitions. The system includes a middle frequency transducer for producing a middle frequency portion of the acoustical signal. The middle frequency transducer directs the acoustical signal into a horn assembly having at least two opposing interior surfaces and an output aperture. The system further includes a low frequency driver for producing a low frequency portion of the acoustical signal. The low frequency driver includes a first low frequency transducer having a first voice coil and a second low frequency transducer having a second voice coil, wherein a distance D1 measured from said first voice coil to said second voice coil is related to a second distance D2 measured across the output aperture.

In another embodiment, the ratio of D1 to D2 is substantially equal to 0.9048.

In another embodiment, the first and second low frequency-range transducers are fixedly attached to opposing interior surfaces of the horn assembly.

In another embodiment, the opposing interior surfaces of the horn assembly include a top interior surface and a bottom interior surface, the beamwidth is defined in a vertical plane relative to said loudspeaker system, and the distance D2 is measured from an uppermost boundary of the aperture to a lowermost boundary of said output aperture.

In another embodiment, the first low frequency transducer is incorporated into the top interior surface of the horn assembly and the second low frequency transducer is incorporated into the bottom interior surface, such that a plurality of radiating surfaces of the transducers are substantially flush with the interior surfaces.

In another embodiment, the system further includes a crossover network for separating the electrical signal into at least a low frequency component and a middle frequency component, and for providing the low frequency component to the low frequency driver and the middle frequency component to the middle frequency driver.

And in yet another embodiment, the plurality of frequency transitions includes a low frequency to middle frequency transition.

BRIEF DESCRIPTION OF THE DRAWINGS

The foregoing and other objects of this invention, the various features thereof, as well as the invention itself, may be more fully understood from the following description, when read together with the accompanying drawings in which.

DETAILED DESCRIPTION OF THE INVENTION

Figure 1:
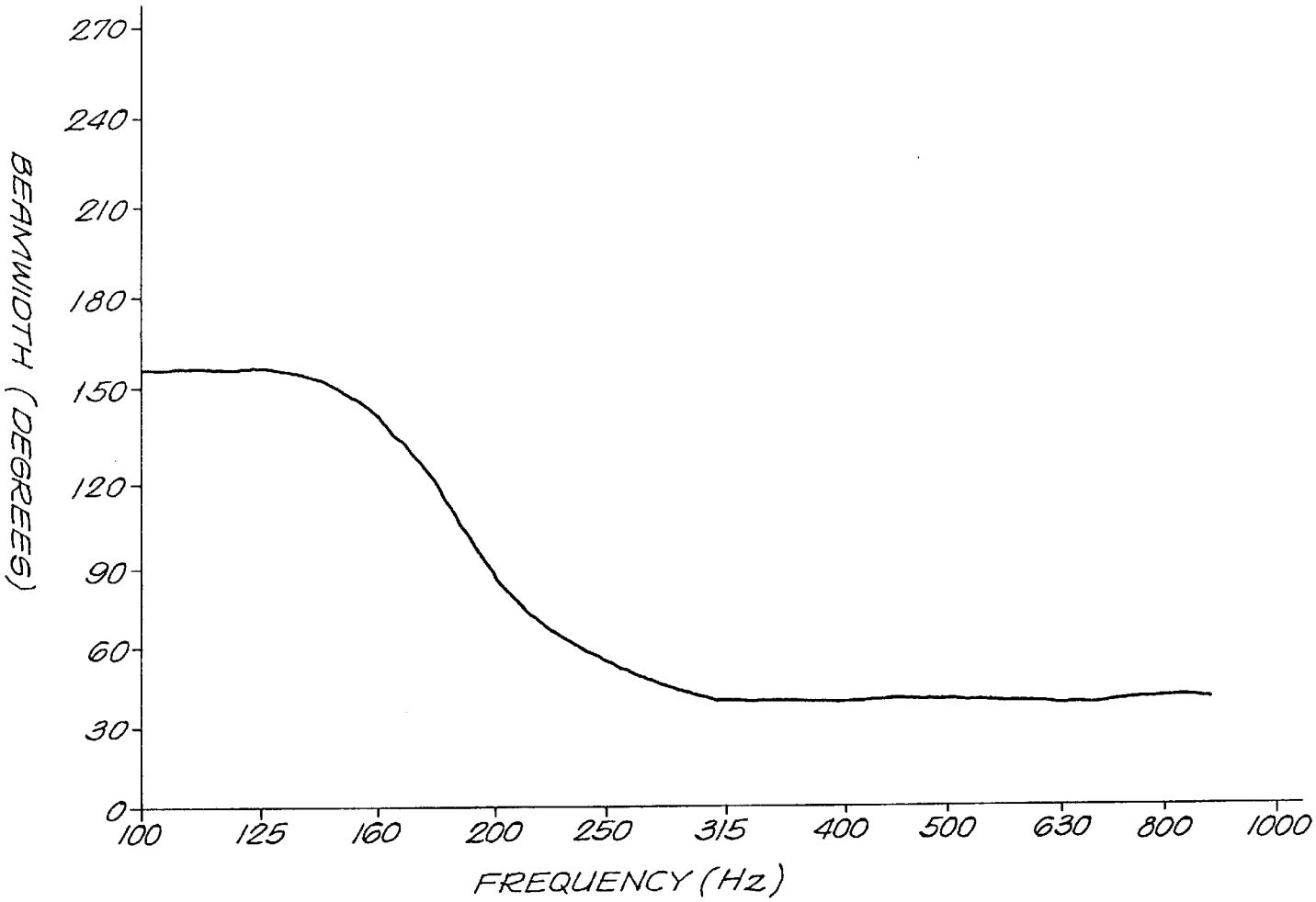
FIG. 1 shows a practical vertical beamwidth-verses-frequency goal.
Figure 2:
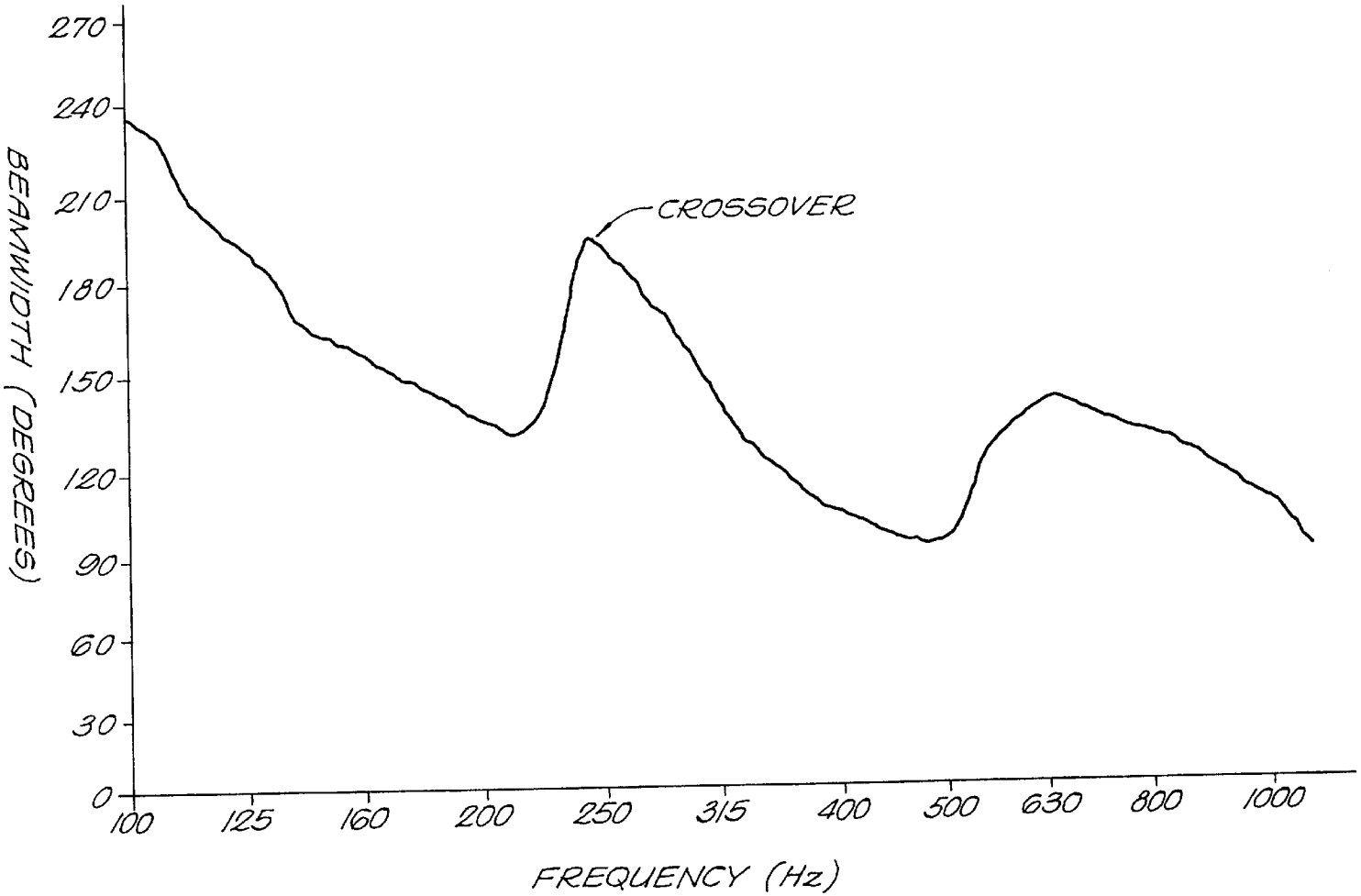
FIG. 2 shows a graphical representation of beamwidth discontinuities which may occur at the crossover frequencies of a prior art loudspeaker system.
Figure 3:
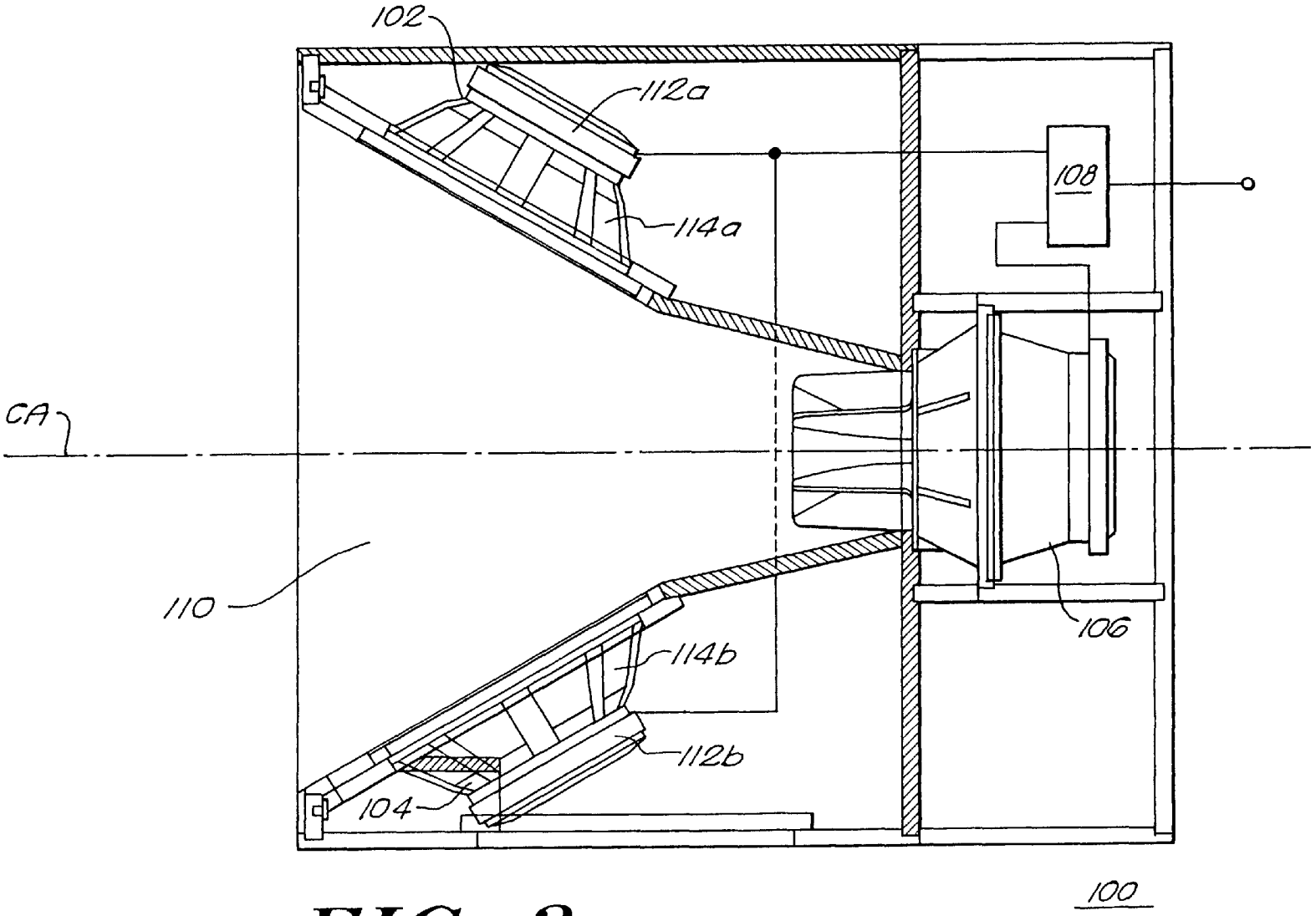
FIG. 3 illustrates a sectional view of one preferred embodiment of an improved loudspeaker system according to the present invention.

The invention is directed to an improved loudspeaker system which increases low frequency directivity and minimizes directivity discontinuities during frequency transitions, e.g., transitions from low frequency transducers to middle frequency transducers. FIG. 3 illustrates a sectional view of one preferred embodiment of an improved loudspeaker system 100 according to the present invention, including a first low frequency transducer 102, a second low frequency transducer 104, a middle frequency transducer assembly 106 and a crossover network 108. The transducer assemblies are mounted to a horn assembly 110, a four sided, flared channel between a small aperture and a large aperture, disposed symmetrically about a central axis CA. The axis CA thus passes through the centers of the small aperture and large aperture, and is substantially normal to the planes defined by the small aperture and large aperture. The middle frequency transducer assembly 106 is attached to the small aperture of the horn assembly 110 and directs a middle frequency acoustical signal into the horn assembly 110. The low frequency transducers 102 and 104 are mounted to mutually opposing interior surfaces of the horn assembly 110 and direct a low frequency acoustical signal into the horn assembly 110. In the illustrated embodiment, the first low frequency transducer 102 is mounted to the upper interior surface of the horn assembly 110 and the second low frequency transducer 104 is mounted to the lower interior surface of the horn assembly 110. The low frequency transducers 102 and 104 are both mounted to the horn assembly 110 such that the radiating surfaces of the transducers are substantially flush with the interior surfaces of the horn assembly 110. Other embodiments of the invention may include low frequency transducers mounted at other locations within the horn assembly 110.

In a preferred embodiment, the low frequency transducers 102 and 104 each include a voice coil 112*a* and 112*b*, respectively, and a driver cone 114*a* and 114*b*, respectively, although other types of low frequency transducers may used. Each voice coil 112 receives an electrical signal representing a low frequency band and produces mechanical vibrations in the driver cone 114 representative of the electrical signal. The mechanical vibrations in the driver cone 114 in turn produce an acoustical signal which is directed into the horn assembly 110. The middle frequency transducer assembly 106 includes a driver assembly, a phase plug assembly, and a throat mode barrier. One such transducer assembly 106 is described in a copending U.S. Patent Application, entitled "HORN-TYPE LOUDSPEAKER SYSTEM," (Attorney Docket No. EAWK-003) which is assigned to the same assignee as the present invention and which is incorporated herein in its entirety by reference. The middle frequency transducer assembly receives an electrical signal representing a middle frequency band and produces an acoustical signal which is directed into the horn assembly 110 via the small aperture. In the illustrated embodiment, the low frequency electrical signal and the middle frequency electrical signal are provided by the crossover network 108, although these electrical signals may be provided separately by other sources. In general, a crossover network is a device that receives a composite electrical signal representing a wide frequency band, decomposes the composite signal into its constituent frequency bands and provides several output signals, each of which corresponds to one of the constituent frequency bands.

In the embodiment shown in FIG. 3, the vertical beamwidth of the loudspeaker is defined within a vertical plane that contains the central axis CA, and is substantially orthogonal to the lines formed by the top and bottom sides of the horn apertures. This vertical plane (shown as the plane of each of FIGS. 3 and 4) essentially bisects the loudspeaker into a left side and a right side. The beamwidth of a system is defined as the angle that includes all of the acoustical output that is within 6 dB of the maximum output. In general, the maximum output may occur anywhere within the vertical plane, either on-axis or off-axis.

Figure 4:
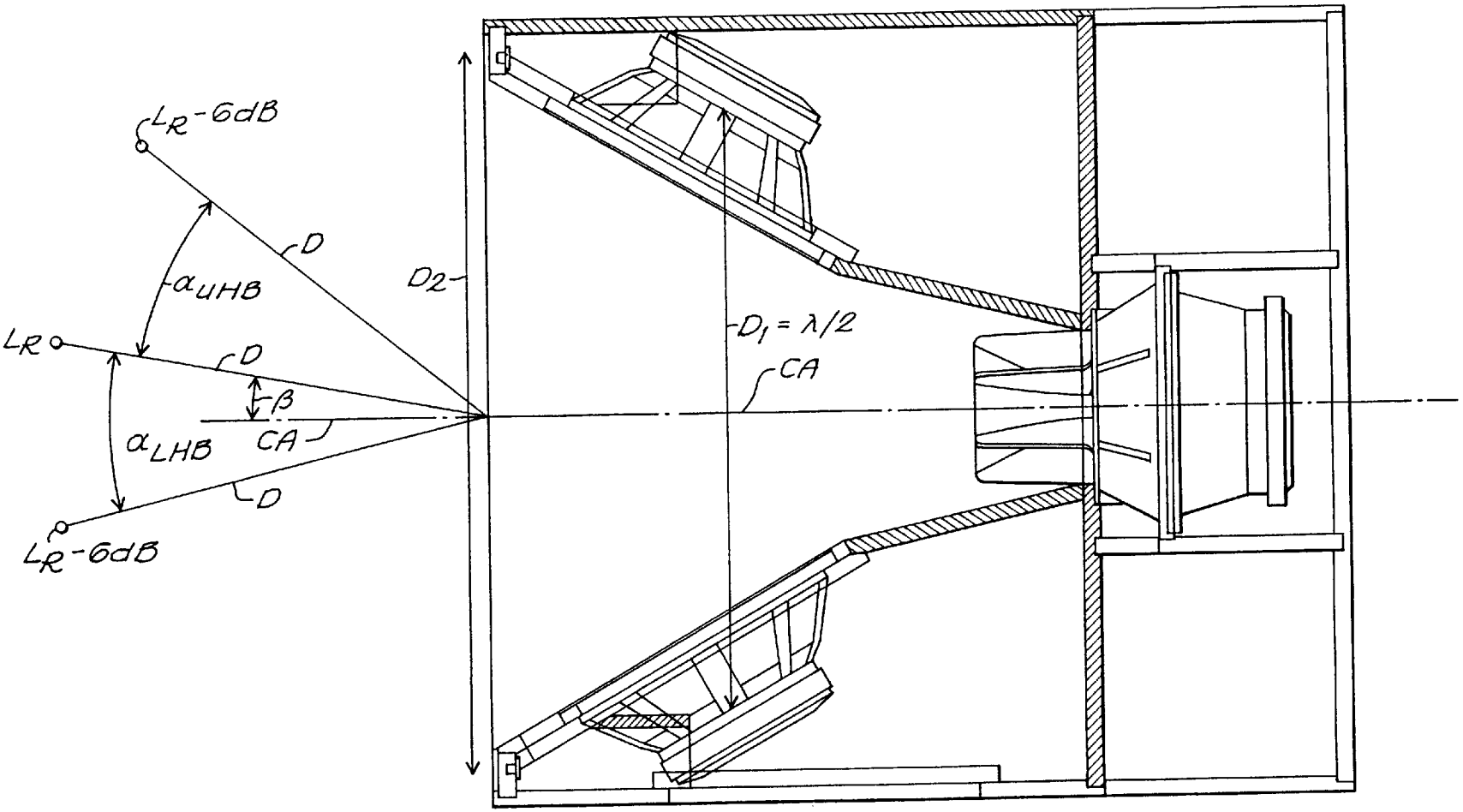
FIG. 4 illustrates the vertical beamwidth of a loudspeaker system.

FIG. 4 illustrates an exemplary vertical beamwidth of a loudspeaker having a maximum output direction off-axis by an angle of $\beta$. From the large, output aperture of the horn assembly 110, a reference acoustical level $L_R$ is measured within the vertical plane at a predetermined distance D in the maximum output direction. Then the acoustical level is measured at an angle $\alpha$ above the maximum output direction within the vertical plane and at the same predetermined distance D. The angle $\alpha$ is increased until the measured acoustical level is 6 dB below the reference level. The resulting angle is the upper half-beamwidth angle $\alpha_{UHB}$. The same procedure is repeated below the maximum output direction to determine the lower half-beamwidth angle $\alpha_{LHB}$. The sum of $\alpha_{UHB}$ and $\alpha_{LHB}$ represents the vertical beamwidth of the loudspeaker.

For the acoustical signal produced by the low frequency transducers in the illustrated embodiment, an acoustical null occurs above and below the transducers when the distance $D_1$ measured from the upper transducer voice coil 112*a* to the lower transducer voice coil 112*b* (as shown in FIG. 4) is $\lambda/2$, where $\lambda$ is the wavelength of the acoustical signal radiated by the low frequency transducers. The frequency corresponding to such a wavelength is referred to as the Maximum Off-Axis Rejection Frequency $f_{MOR}$. Over the ⅓ octave band including $f_{MOR}$, the loudspeaker yields a beamwidth of approximately 160 degrees. In terms of $D_1$ and the speed of sound c, $f_{MOR}$ may be expressed as:

$$f_{MOR} = \frac{c}{2D_1} \quad 1$$

For the acoustical signal produced by the middle frequency transducer, the vertical beamwidth $\phi_v$ is dependent upon the frequency of the acoustical signal $f_s$, and the distance $D_2$ measured from the bottom edge of the output aperture to the top edge of the output aperture (as shown in FIG. 4), as follows:

$$f_s = \frac{1.2\times 10^6}{(\phi_v)(D_2)} \quad 2$$

The optimal crossover frequency between the low to middle frequencies therefore occurs at the $f_s$ corresponding to $\phi_v$=160 degrees, and $f_s=f_{MOR}$, or:

$$\frac{c}{2D_1} = \frac{1.2\times 10^6}{(160_{degrees})(D_2)} \quad 3$$

Substituting 13,572 in/sec for the speed of sound c, equation 3 reduces to:

$$\frac{D1}{D2} = 0.9048 \quad 4$$

Thus, in order to have a smooth transition from the low frequency transducers to the middle frequency transducers without a significant beamwidth discontinuity at 160 degrees, the distance $D_1$ measured from the upper transducer voice coil 112*a* to the lower transducer voice coil 112*b* should be just over 90 percent of the distance $D_2$ measured from the bottom edge of the output aperture to the top edge of the output aperture.

Figure 5:
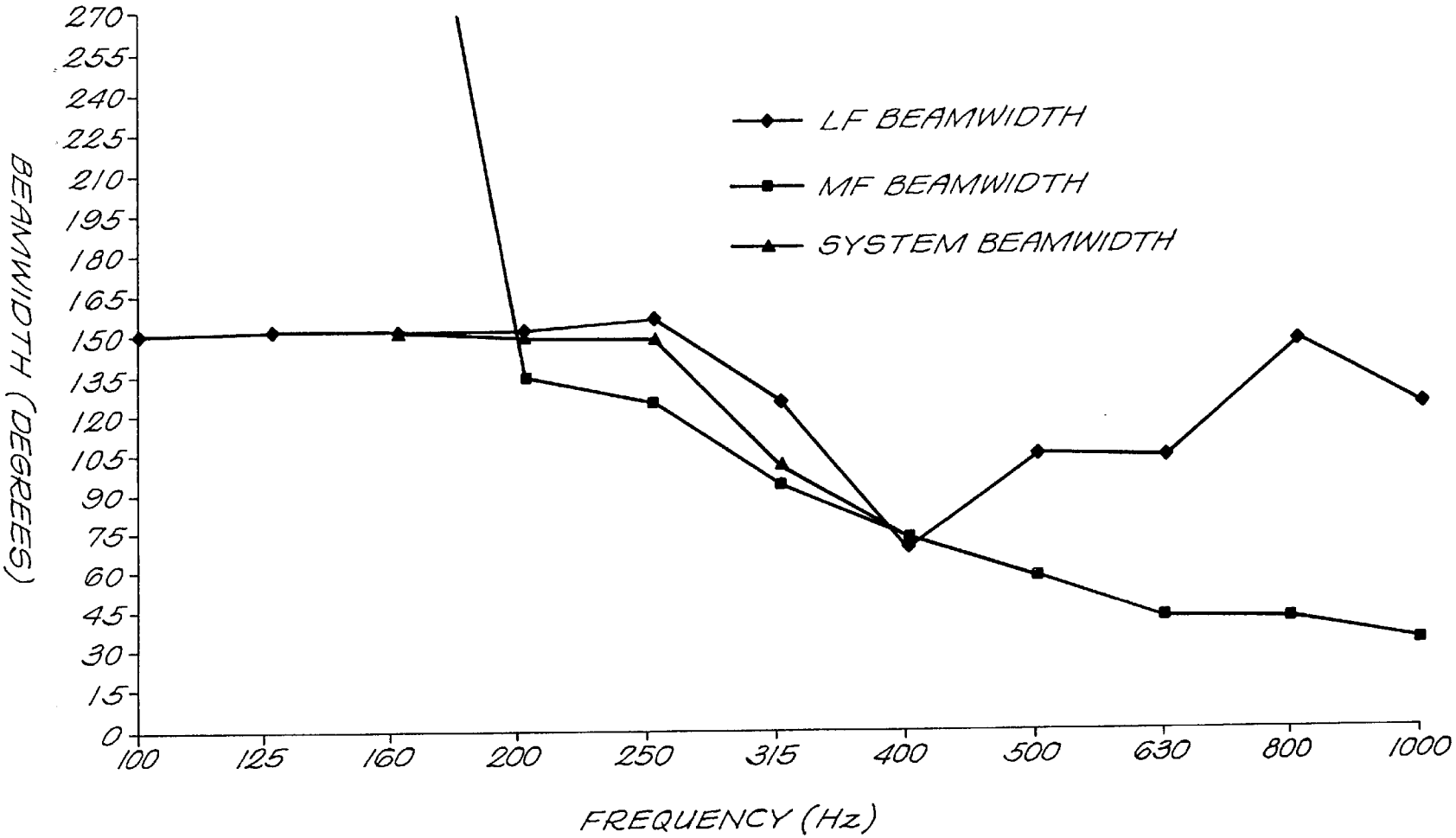
FIG. 5 illustrates the individual beamwidth response of the low frequency transducers, the middle frequency transducer, and the overall response when the transducers are combined via the crossover network; and, FIG. 6 shows a comparison of the beamwidth characteristics of the illustrated embodiment and a typical prior art loudspeaker.

FIG. 5 illustrates the individual beamwidth response of one arrangement of the low frequency transducers 102 and 104, the middle frequency transducer 106, and the overall response when the transducers are combined via the crossover network 108. The low frequency beamwidth graphic, represented by the line having diamond shaped reference markers, shows that the low frequency transducers undershoot the target beamwidth of 160 degrees, but maintain a beamwidth of 150 degrees up close to the desired 280 Hz frequency transition point. The middle frequency beamwidth graphic, represented by the line in FIG. 5 having square shaped reference markers, shows that the middle frequency transducer produces the target 35 degree target vertical beamwidth at approximately 800 Hz, and then widens with decreasing frequency to approximately 150 degrees at approximately 200 Hz. The graphic of the composite beamwidth produced by the combination of the low frequency transducers 102 and 104, and the middle frequency transducer 106 is represented by the line having triangle-shaped reference markers. The composite beamwidth graphic shows that the transition from low frequency to middle frequency is relatively smooth with no apparent discontinuities.

Figure 6:
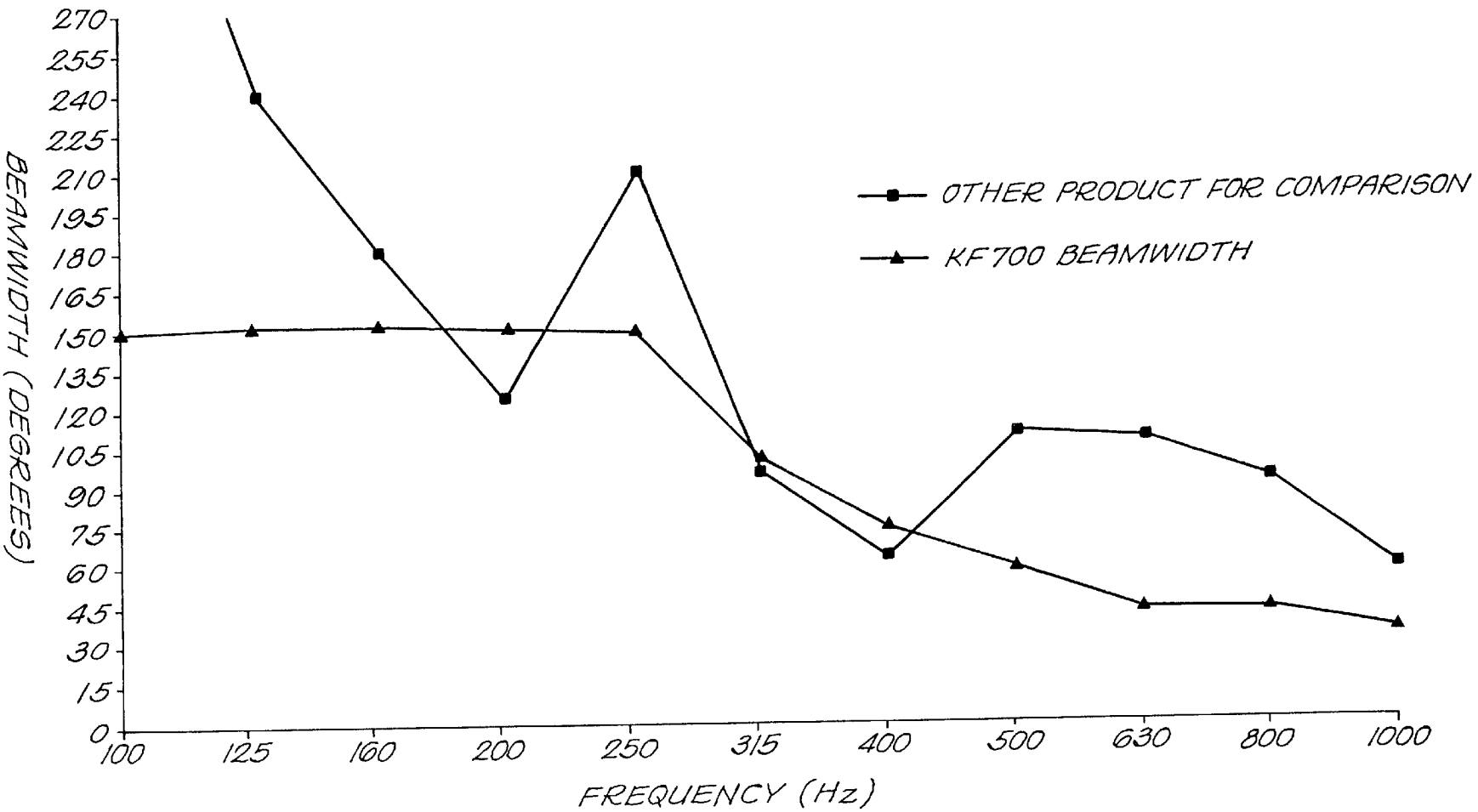

FIG. 6 shows a comparison of the beamwidth verses frequency characteristics of the illustrated embodiment and the beamwidth verses frequency characteristics of a typical prior art loudspeaker. The beamwidth graphic of the illustrated embodiment (referred to in the figure as KF700) is represented by the line in FIG. 6 having triangle shaped reference markers, and the beamwidth graphic of the prior art loudspeaker is represented by the line in FIG. 6 having square shaped reference markers. FIG. 6 shows that the prior art loudspeaker actually drives the low frequency transducers too high in frequency (e.g., the narrowing at approximately 200 Hz), and then transitions into an undersized middle frequency horn which does not provide adequate pattern control at approximately 250 Hz. Such a beamwidth discontinuity is very audible and dramatically impacts the capability of prior art devices to be arrayed with predictable results.

It should be noted that in general, the relative positioning of the low frequency transducers 102 and 104 relative to the middle frequency transducer 106 is not particularly critical, as long as the voice coil to voice coil distance D1 is approximately 90 percent of the vertical aperture dimension D2, as described in detail herein. For instance, the low frequency transducers 102 and 104 could be stacked with respect to the middle frequency transducer 106 to achieve substantially identical acoustical results. However, by incorporating the low frequency transducers 102 and 104 into the middle frequency horn as does the illustrated embodiment, the invention exhibits significantly continuous beamwidth characteristics over the working frequency range in a physical package which is quite small relative to prior art loudspeakers having a similar frequency response and a common origin.

The invention may be embodied in other specific forms without departing from the spirit or essential characteristics thereof. The present embodiments are therefore to be considered in respects as illustrative and not restrictive, the scope of the invention being indicated by the appended claims rather than by the foregoing description, and all changes which come within the meaning and range of the equivalency of the claims are therefore intended to be embraced therein.

What is claimed is:

1. A loudspeaker system for receiving an electrical signal and transmitting an acoustical signal, said acoustical signal being directional and having a substantially continuous beamwidth across a plurality of frequency transitions, comprising:

a horn-loaded, middle frequency transducer for producing a middle frequency portion of said acoustical signal, said middle frequency transducer directing said acoustical signal into a horn assembly having at least two opposing interior surfaces and an output aperture, said middle frequency transducer and said horn assembly having a common central axis; and, a direct radiating, low frequency driver for producing a low frequency portion of said acoustical signal, including a first low frequency transducer having a first voice coil and a second low frequency transducer having a second voice coil, wherein a distance D1 measured from said first voice coil to said second voice coil is related to a second distance D2 measured across said output aperture.

2. A loudspeaker system according to claim 1, wherein a ratio of D1 to D2 is substantially equal to 0.9048.

3. A loudspeaker system according to claim 1, said first and second low frequency-range transducers being fixedly attached to opposing interior surfaces of said horn assembly.

4. A loudspeaker system according to claim 3, wherein said opposing interior surfaces of said horn assembly include a top interior surface and a bottom interior surface, said beamwidth is defined in a vertical plane relative to said loudspeaker system, and said distance D2 is measured from an uppermost boundary of said aperture to a lowermost boundary of said aperture.

5. A loudspeaker system according to claim 4, said first low frequency transducer being incorporated into said top interior surface of said horn assembly and said second low frequency transducer being incorporated into said bottom interior surface, such that a plurality of radiating surfaces of said transducers are substantially flush with said interior surfaces.

6. A loudspeaker system according to claim 1, further including a crossover network for separating said electrical signal into at least a low frequency component and a middle frequency component, and for providing said low frequency component to said low frequency driver and said middle frequency component to said middle frequency driver.

7. A loudspeaker system according to claim 1, wherein said plurality of frequency transitions includes a low frequency to middle frequency transition.

8. A loudspeaker system according to claim 7, wherein said low frequency to middle frequency transition occurs within a frequency band substantially centered at 280 Hz.

* * * * *